US006485034B1

(12) United States Patent
Chou

(10) Patent No.: US 6,485,034 B1
(45) Date of Patent: Nov. 26, 2002

(54) ROLLER ASSEMBLY OF IN-LINE ROLLER SKATE

(76) Inventor: Tien-Chiu Chou, 6F, No. 185, Sec. 1, Taichung Kang Road, Taichung City (TW)

( * ) Notice: Subject to any disclaimer, the term of this patent is extended or adjusted under 35 U.S.C. 154(b) by 0 days.

(21) Appl. No.: 09/340,168

(22) Filed: Jun. 28, 1999

(51) Int. Cl.[7] ..... A63C 1/28; A63C 17/14

(52) U.S. Cl. ..... 280/11.28; 280/11.211; 280/11.224

(58) Field of Search ..... 280/11.204, 11.211, 280/11.214, 11.215, 11.217, 11.221, 11.224, 11.27, 11.28

(56) References Cited

U.S. PATENT DOCUMENTS 3,339,936 A * 9/1967 Hamlin ..... 280/11.204
5,192,099 A * 3/1993 Riutta ..... 280/11.214
5,232,231 A 8/1993 Carlsmith
5,478,094 A * 12/1995 Pennestri ..... 280/11.2
5,503,413 A * 4/1996 Belogour ..... 280/11.214
5,513,862 A * 5/1996 Chuang ..... 280/11.214
5,639,104 A * 6/1997 Haldemann ..... 280/11.214
5,797,608 A * 8/1998 Haldemann ..... 280/11.214
5,890,722 A * 4/1999 Smith et al. ..... 280/11.214
5,890,724 A * 4/1999 Smith et al. ..... 280/11.214
5,927,728 A * 7/1999 Gignoux et al. ..... 280/11.214
5,979,916 A * 11/1999 Gatel et al. ..... 280/11.214
6,045,142 A * 4/2000 Andrich ..... 280/11.22
6,131,921 A * 10/2000 Ellis et al. ..... 280/11.2

* cited by examiner

*Primary Examiner*—Brian L. Johnson
*Assistant Examiner*—Jeff Restifo
(74) *Attorney, Agent, or Firm*—Browdy and Neimark, P.L.L.C.

(57) ABSTRACT

A roller assembly of an in-line roller skate fastened to the sole of a boot for gliding on a surface and formed of a roller frame with wheels, a boot frame fastened pivotally with the roller frame, a braking mechanism fixed on the boot frame, and a biasing mechanism mounted between the roller frame and the boot frame.

5 Claims, 5 Drawing Sheets

ROLLER ASSEMBLY OF IN-LINE ROLLER SKATE

FIELD OF THE INVENTION

The present invention relates generally to an in-line roller skate, and more particularly to the in-line roller skate provided with a roller assembly capable of braking effectively.

BACKGROUND OF THE INVENTION

Generally speaking, the braking action of the conventional in-line roller skate takes two forms, one of which is a projection located at the toe end of the roller skate, as shown in FIG. 1. The roller skate in motion is slowed down or stopped by pressing the projection against a surface on which the roller skate glides. The effect of this braking method is limited in view of the fact that the braking action is brought to pass by the trailing roller skate, as shown in FIG. 1, and that the braking action is seriously compromised by the skater's posture which is prone to inhibit the skater from exerting a greater force on the trailing roller skate. Now referring to FIG. 2, another form of braking a roller skate in motion is a brake pad located at the heel end of the roller skate. The brake pad is pressed against a surface on which the roller skate glides. The braking action of the brake pad is also limited in view of the fact that the body weight of a skater is mostly supported by the trailing roller skate at the time when the braking action is effected by the brake pad of the leading roller skate, as illustrated by FIG. 2. In addition, the problem is further compounded by the fact that the toe end of the leading roller skate must be lifted, thereby inhibiting the leg muscles of the skater from exerting a greater force on the brake pad. In the event that the skater makes an attempt to exert a greater pressure on the brake pad of the leading roller skate, the skater is prone to lose a balance.

With a view to overcoming the drawbacks of the conventional in-line roller skates described above, the U.S. Pat. No. 5,232,231 discloses a roller skate comprising a boot which is provided in the bottom thereof with side plates for pivoting the boot to a roller frame. The roller skate further comprises a lever mechanism located between the boot and the roller and is controlled by the lever mechanism. As the heel is pressed, the braking action is effected by each brake pad to slow down or stop the motion of the roller due to the lever principle. Such a roller skate braking structure of the prior art as described above is still defective in design in that it is not compatible with the roller skates currently available in the market place, and that it is formed of many component parts which result in a substantial increase in weight of the roller skate. In addition, this prior art braking structure tends to bring the rollers in motion to an abrupt halt, thereby resulting in a reaction force which makes the roller skater vulnerable to fall.

SUMMARY OF THE INVENTION

It is the primary objective of the present invention to provide an in-line roller skate with a roller assembly capable of a braking action without regard to the posture of a roller skater.

It is another objective of the present invention to provide an in-line roller skate with a roller assembly capable of slowing down or stopping the motion of rollers thereof in a progressive manner.

It is still another objective of the present invention to provide an in-line roller skate with a roller assembly compatible with the ordinary roller skates available in the market place.

It is still another objective of the present invention to provide an in-line roller skate with a roller assembly having a braking mechanism which is removably mounted therein.

In keeping with the principle of the present invention, the foregoing objectives of the present invention are attained by a roller assembly which is fastened with the sole of a boot for gliding on a surface and is formed of a roller frame, a boot frame fastened pivotally with the roller frame, a braking mechanism mounted on the boot frame, a biasing mechanism mounted between the roller frame and the boot frame, and a switch mounted between the roller frame and the boot frame. The boot frame is fastened pivotally with the roller frame by at least one fulcrum on which one end of the boot frame turns toward a first direction, thereby resulting in other end of the boot frame to displace in a second direction opposite to the first direction. The roller frame is provided with a plurality of rollers fastened therewith such that at least one roller is opposite to the braking mechanism. This roller is kept apart from the braking mechanism by an interval at the time when the boot frame is located at a first position. This roller is acted on by the braking mechanism at the time when the boot frame is located at a second position. The biasing mechanism is used to bring about a biasing force to keep the boot frame at the first position at such time when the boot frame is not exerted on by an external force. When one end of the boot frame is exerted on by an external force opposite to and greater than the biasing force, the boot frame is moved to the second position. When the switch is turned "OFF", the boot frame is always kept at the first position, regardless of absence or presence of the external force. On the other hand, when the switch is "ON", the boot frame is capable of moving between the first position and the second position.

DETAILED DESCRIPTION OF THE INVENTION

Figure 1:
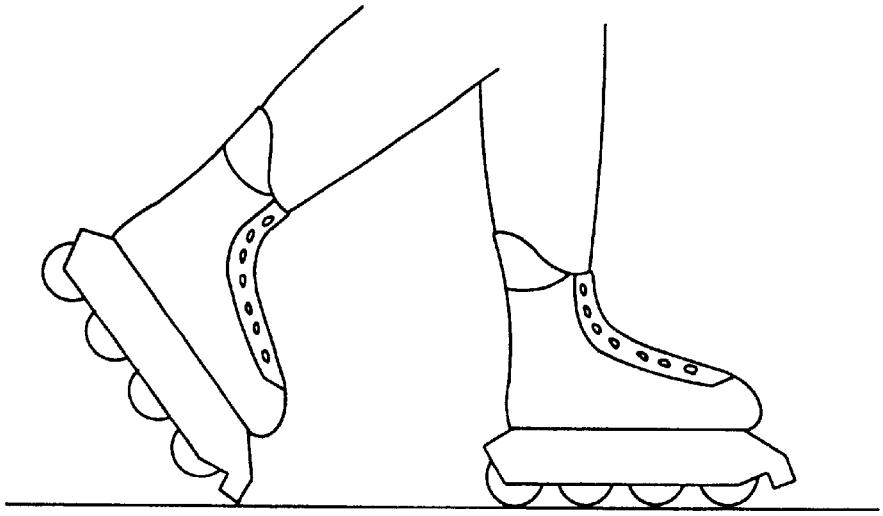
FIG.1 PRIOR ART
FIG. 1 shows a schematic view of a braking action of the prior art in-line roller skate.
Figure 2:
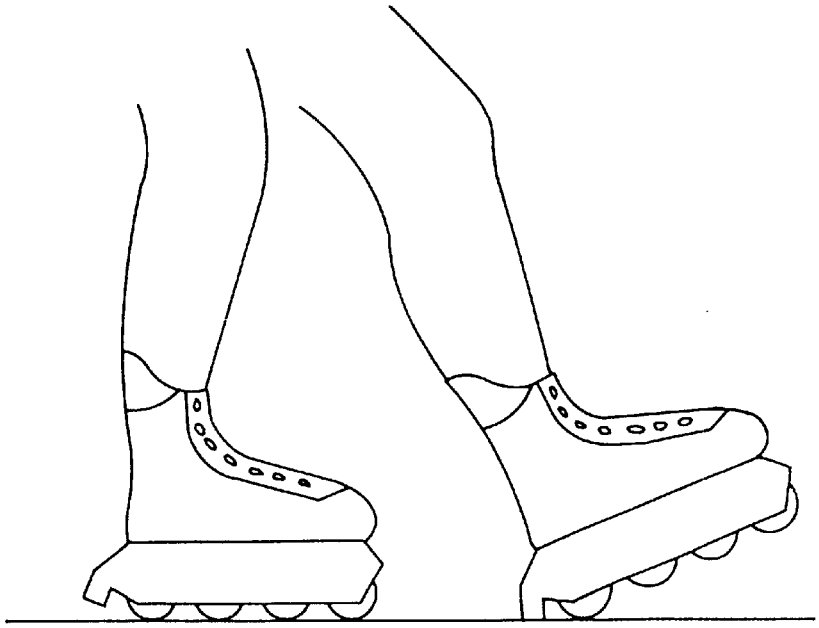
FIG. 2 PRIOR ART
FIG. 2 shows a schematic view of another braking action of the prior art in-line roller skate.
Figure 3:
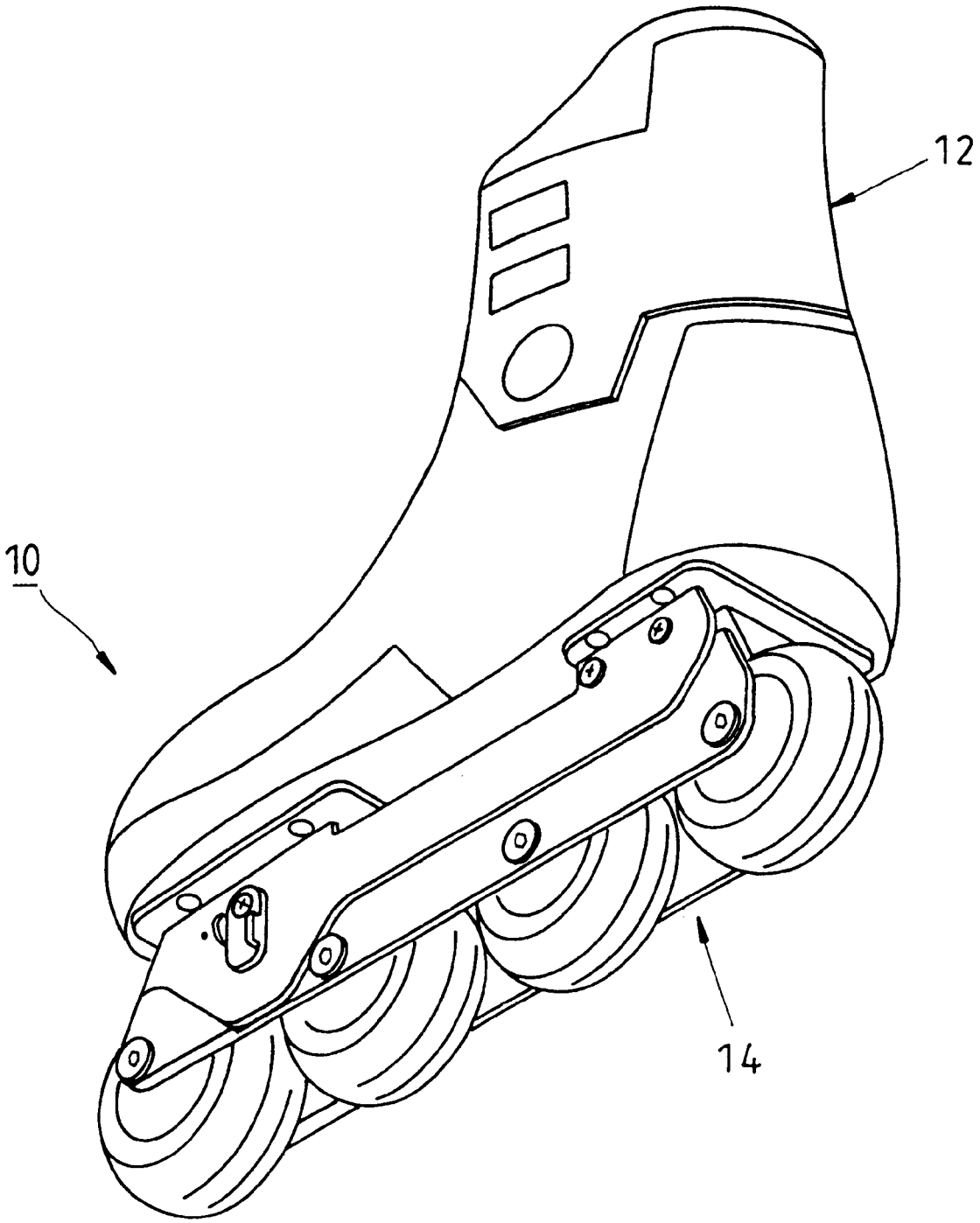
FIG. 3 shows a perspective view of an in-line roller skate comprising a boot fastened with a roller assembly of a preferred embodiment of the present invention.
Figure 4:
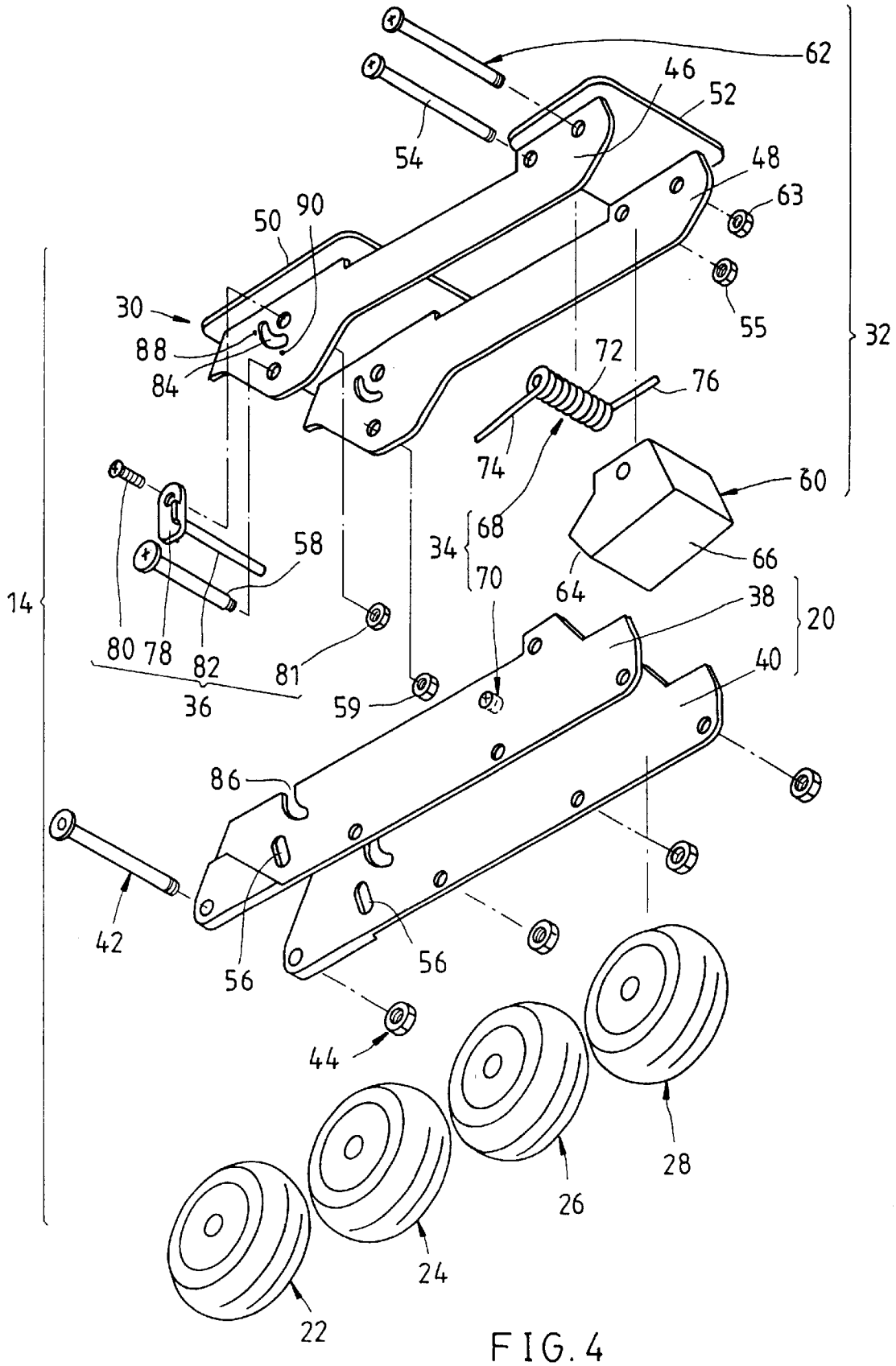
FIG. 4 shows an exploded view of the roller assembly of the preferred embodiment of the present invention.

As shown in FIGS. 3–7, an in-line roller skate 10 embodied in the present invention comprises a boot 12 and a roller assembly 14 fastened with the sole of the boot 12 by a fastening means.

The roller assembly 14 of the present invention is formed of a roller frame 20, four rollers 22, 24, 26, and 28 which are linearly pivoted to the roller frame 20, a boot frame 30 fastened pivotally with the roller frame 20, a braking mechanism 32 mounted on the boot frame 30, a biasing mechanism 34 disposed between the roller frame 20 and the boot frame 30, and a switch 36 located between the roller frame 20 and the boot frame 30.

The roller frame 20 has two side plates 38 and 40 parallel to each other. The rollers 22, 24, 26 and 28 are respectively pivoted between the two side plates 38 and 40 by a pin 42 and a nut 44 such that the rollers are arranged in alignment, and that the rollers glide coplanarly. The rollers may be pivoted between the two side plates 38 and 40 by an appropriate means other than the means described above.

The boot frame 30 has two side plates 46 and 48, which are arranged separately in a parallel manner by two bracing plates 50 and 52 mounted on both ends of the two side plates 46 and 48. The two side plates 46 and 48 are separated by a distance large enough to enable the boot frame 30 to fit over the roller frame 20. The front bracing plate 50 is fastened with the toe portion of the sole of the boot 12, whereas the rear bracing plate 52 is fastened with the heel portion of the sole of the boot 12.

Figure 7:
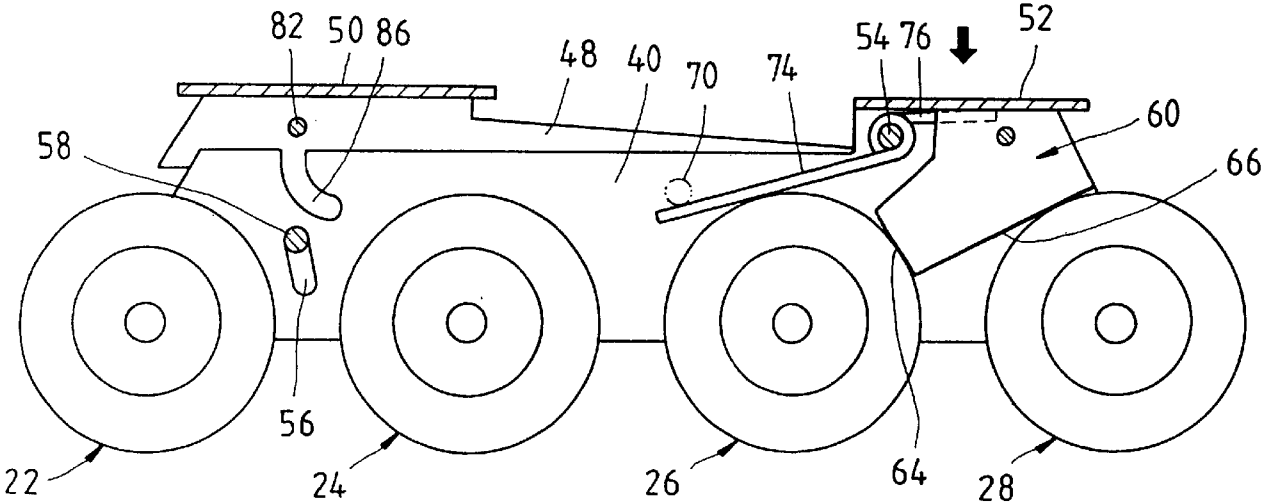
FIG. 7 is a partial sectional schematic view showing that the boot frame of the preferred embodiment of the present invention is located at the second position.

The roller frame 20 and the boot frame 30 are pivoted together by a first pivot 54 received in the through holes of the rear end of the side plates in conjunction with a nut 55 which is engaged with the pivot 54. The pivot 54 serves as a fixed fulcrum. The front ends of the two side plates 38 and 40 of the roller frame 20 are provided respectively with a bar-shaped hole 56 for receiving a second pivot 58 which is engaged with a nut 59 for forming a movable fulcrum. The present invention is designed in such a way that the rear end of the boot frame 30 is caused to turn on the fixed fulcrum from a first position to a second position at such time when the rear end of the boot frame 30 is exerted on by a downward pressure. In the meantime, the front end of the boot frame 30 turns upward on the movable fulcrum as shown in FIG. 7. It must be noted here that the downward pressure referred to above is brought about by the heel of a skater, and that the first position referred to above is the horizontal position of the boot frame 30 at the time when the body weight of the skater is distributed on the sole.

Figure 6:
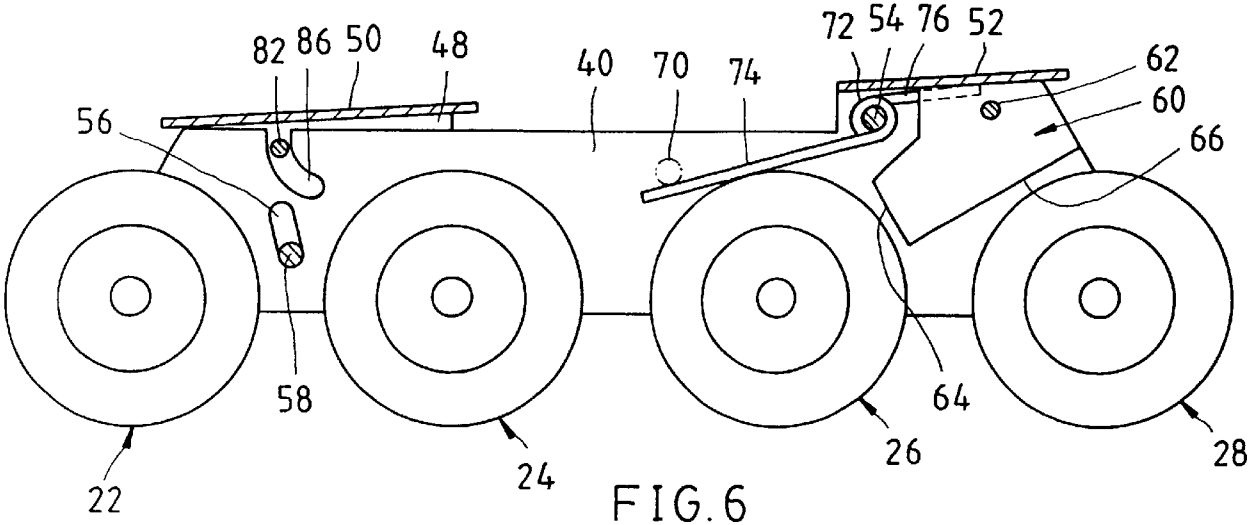
FIG. 6 is a partial sectional schematic view showing that the boot frame of the preferred embodiment of the present invention is located at the first position at the time when the switch is kept in the "ON" state.

The braking mechanism 32 has a brake shoe 60 which is made of a rubber or other resilient and wear-resistant material and is fastened with the rear end of the two side plates of the boot frame 30 by a fastening bolt 62 and a nut 63 in such a way that the brake shoe 60 is located between the third roller 26 and the fourth roller 28. The brake shoe 60 is provided with two inclined planes 64 and 66, which are respectively opposite in location to the rollers 26 and 28. When the boot frame 30 is located at the first position, the brake shoe 60 is kept apart from the rollers 26 and 28 by a predetermined distance, as shown in FIG. 6. When the boot frame 30 is located at the second position, the brake shoe 60 moves downward along with the rear end of the boot frame 30 such that the inclined planes 64 and 66 of the brake shoe 60 are forced against the third roller 26 and the fourth roller 28 to slow down or stop the motion of each of the two rollers 26 and 28, as shown in FIG. 7.

The biasing mechanism 34 has a biasing spring 68 and a retaining tenon 70. The spring 68 has a spiral body 72 and two arms 74 and 76 extending from both ends of the spiral body 72. The spiral body 72 of the preferred embodiment of the present invention is fitted over the first pin 54 or other pin fastened with the roller frame 20 or boot frame 30. The retaining tenon 70 is fastened with the inner side of the side plate 38 of the roller frame 20. The retaining tenon 70 is pressed against by one arm 74 of the spring 68. The underside of the rear bracing plate 52 of the boot frame 30 is pressed against by other arm 76 of the spring 68. The boot frame 30 is thus provided by the spring. 68 with a biasing force to keep the boot frame 30 at the first position at the time when the boot frame 30 is not exerted on by an external force, or at the time when the sole is exerted on by a pressure. The boot frame 30 moves to the second position at such time when the rear end of the boot frame 30 is exerted on by an external force opposite in direction to and greater than the biasing force provided by the spring 68. In other words, the boot frame 30 moves to the second position at the time when the rear end of the boot frame 30 is pressed on by the heel of a skater.

Figure 5:
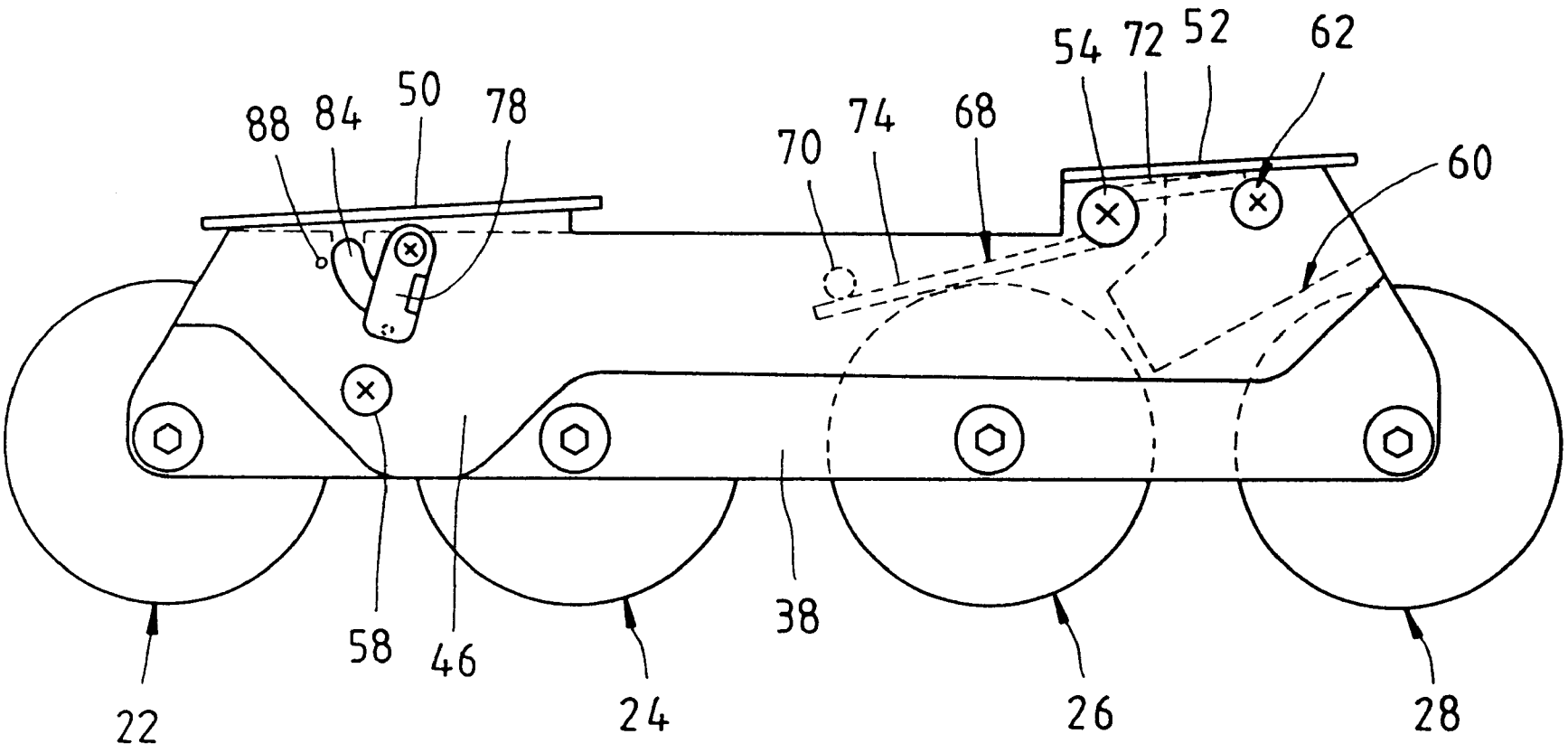
FIG. 5 is a partial sectional schematic view showing that the boot frame of the preferred embodiment of the present invention is located at the first position at the time when the switch is kept in the "OFF" state.

The switch 36 has a lug 78, which is pivotally fastened with the outer side of the side plate 46 of the boot frame 30 by a bolt 80 and a nut 81 such that the lug 78 is fastened with one end of a long rod 82, with other end of the long rod 82 extending inward via an arcuate through hole 84 of the side plate 46. The two side plates 38 and 40 of the roller frame 20 are respectively provided with a retaining portion 86 which is corresponding in location to the bolt 80 and is a curved slot 86 with an opening. The free end of the long rod 82 is located outside the curved slot 86 when the lug 78 is located at a third position which is the upper end of the through hole 84, thereby enabling the boot frame 30 to displace between the first position and the second position along with an external force. The switch 36 remains in the "ON" state at this time. When the lug 78 is moved by an external force to a fourth position which is the lower end of the through hole 84, as shown in FIG. 5, the free end of the long rod 82 is retained in the curved slot 86, thereby causing the boot frame 30 to remain at the first position such that the boot frame 30 is incapable of displacing along with the external force. The switch 36 is now kept in the "OFF" state. The upper end and the lower end of the through hole 84 of the preferred embodiment of the present invention are respectively provided in an edge thereof with a retaining slot 88 (90) which is intended to retain a projection (not shown in the drawings) of the inner side of the open end of the lug 78 at such time when the lug 78 is located at the third position or the fourth position. The switch 36 can be thus prevented from being switched by mistake.

The in-line roller skate 10 can be therefore provided at will by a skater with a braking effect. This is done by moving the lug 78 to locate at the upper end of the through hole 84. If the skater desires to deprive the skate 10 of the braking effect, all he or she has to do is to move the lug 78 to locate at the lower end of the through hole 84, as shown in FIG. 5.

In the course of gliding, the sole is exerted on by most of the body weight of a skater. As a result, the braking mechanism 32 of the skate 10 can not be activated even if the skate 10 is provided with the braking effect, as shown in FIG. 6. Under such a circumstance, if the skater wants to cause the skate 10 in motion to come to a halt, all he or she has to do is to press the rear end of the skate 10 with his or her heel, thereby causing the brake shoe 60 to move downward along with the rear end of the boot frame 30 such that the inclined planes 64 and 66 of the brake shoe 60 press against the third roller 26 and the fourth roller 28 respectively, as shown in FIG. 7. As a result, the gliding motions of the rollers 26 and 28 are stopped by the brake shoe 60. The magnitude of the braking force of the brake shoe 60 is directly proportional to the magnitude of the force exerting on the rear end of the boot frame 30 by the skater's heel. In the event that the skater wishes to resume the gliding, all she or he has to do is to stop pressing the rear end of the boot frame 30 so as to cause the brake shoe 60 to move back up along with the boot frame 30. The rollers 26 and 28 are thus relieved of the braking action of the brake shoe 60.

What is claimed is:

1. A roller assembly of an in-line roller skate, said rollers assembly comprising:

a roller frame;

a plurality of rollers fastened pivotally with said roller frame such that said rollers are arranged linearly, and that said rollers glide in the same plane;

a boot frame fastened pivotally with said roller frame on at least one fulcrum such that a front end or a rear end of said boot frame turns on said fulcrum;

only a single braking mechanism having two inclined surfaces intersecting at an angle fixed directly on said boot frame such that said braking mechanism corresponds in location to two rollers of said plurality of rollers, the two rollers being located below the rear end of said boot frame behind said fulcrum, said braking mechanism being separated from said two rollers by a distance when said boot frame is located at a first position, wherein each of said two surfaces are located between the two rollers and each simultaneously engage one of the two rollers when said boot frame is located at a second position to stop revolution of said two rollers; and a biasing mechanism mounted between said roller frame and said boot frame for providing said boot frame with a biasing force to keep said boot frame at said first position at the time when said boot frame is not exerted on by an external force whereby said boot frame is forced to locate at said second position at the time when one end of said boot frame is exerted on by an external force opposite in direction to and greater than said biasing force;

wherein said boot frame is fastened pivotally with said roller frame by a movable fulcrum, and a fixed fulcrum corresponding in location to the heel of a boot mounted on said boot frame, said fixed fulcrum being separated from said movable fulcrum by a distance; and wherein said rear end of said boot frame turns on said fixed fulcrum toward a first direction, thereby resulting in said front end of said boot frame to turn on said movable fulcrum toward a second direction opposite to said first direction;

wherein said roller frame is formed of two side plates arranged side by side at an interval such that said two side plates are parallel to each other; wherein said rollers are fastened pivotally with said roller frame in such a manner that said rollers are fastened between said two side plates; wherein said boot frame is formed of two side plates, a front bracing plate, and a rear bracing plate, said two side plates being held together by said front bracing plate and said rear bracing plate such that said two side plates are parallel to each other and are separated from each other by a distance greater than said interval between said two side plates of said roller frame whereby said boot frame is fitted over said roller frame such that said front bracing plate of said boot frame is fastened with the toe portion of a boot, and that said rear bracing plate of said boot frame is fastened with the heel portion of the boot; and wherein said side plates of said roller frame and said boot frame are pivotally fastened at a rear end thereof by a first pivot serving as said fixed fulcrum.

2. The roller assembly as defined in claim further comprising a switch mounted between said roller frame and said boot frame such that said switch remains in an "OFF" state to keep said boot frame at said first position regardless of absence or presence of an external force exerting on said boot frame, and that said switch remains in an "ON" state to enable said boot frame to displace from said first position to said second position and vice versa.

3. The roller assembly as defined in claim 2, wherein said switch has a lug fastened with an outer side of one of said two side plates of said boot frame such that said lug is displaced between a third position and a fourth position, said switch further having a rod fastened at one end thereof with said lug such that other end thereof is extended toward an inner side of said side plates of said boot frame, said switch further having a retaining portion located on one of said two side plates of said roller frame whereby said rod has a free end which is not in contact with said retaining portion at such time when said lug is located at said third position, thereby enabling said switch to remain in an "ON" state, said free end of said rod coming in contact with said retaining portion at such time when said lug is located at said fourth position, thereby enabling said switch to remain in an "OFF" state.

4. The roller assembly as defined in claim 3, wherein said side plates of said boot frame are provided with an arcuate through hole corresponding in location to said lug; wherein said retaining portion is a curved slot having an opening; wherein said lug is fastened pivotally at one end thereof with said side plates, and at other end thereof with one end of said rod whereby said rod has a free end extending toward an inner side of said side plate via said through hole such that said free end of said rod is located outside said curved slot at the time when said lug is located at one end of said through hole, thereby causing said switch to remain in the "ON" state, and that said free end of said rod is located inside said curved slot at the time when said lug is located at other end of said through hole, thereby causing said switch to remain in the "OFF" state.

5. A roller assembly of an in-line roller skate, said roller assembly comprising:

a roller frame having two side plates which are arranged side by side such that said two side plates are parallel to each other, and that said two side plates are separated from each other by an interval;

a plurality of rollers fastened pivotally between said two side plates;

a boot frame having two side plates which are arranged side by side such that said two side plates are parallel to each other, and that said two side plates are separated from each other by a distance greater than said interval between said two side plates of said roller frame whereby said two side plates of said boot frame are held together by a front bracing plate fastened with front ends of said two side plates, and by a rear bracing plate fastened with rear ends of said two side plates, said boot frame being fitted over said roller frame such that a boot is mounted on said boot frame, and that the toe portion of the boot is fastened with said front bracing plate, and further that the heel portion of the boot is fastened with said rear bracing plate;

said side plates of said roller frame and said boot frame are fastened pivotally at a rear end thereof with a first pivot acting as a fixed fulcrum whereby said two side plates of said roller frame are provided at a front end thereof with a bar-shaped hole and a second pivot passing through front ends of said two side plates of said boot frame and said bar-shaped holes of said two side plates of said roller frame to form a moveable fulcrum whereby said rear end of said boot frame turns on said fixed fulcrum toward a first direction, thereby causing said front end of said boot frame to turn on said movable fulcrum toward a second direction opposite to said first direction;

only a single braking mechanism having two inclined surfaces intersecting at an angle fixed directly on said boot frame such that said braking mechanism corresponds in location to two rollers of said plurality of rollers, the two rollers being located below the rear end of said boot frame behind said fulcrum, said braking mechanism being separated from said two rollers by a distance when said boot frame is located at a first position, wherein each of said two surfaces are located between the two rollers and each simultaneously engage one of the two rollers when said boot frame is located at a second position to stop revolution of said two rollers; and a biasing mechanism mounted between said roller frame and said boot frame and formed of a biasing spring, and a tenon fastened on an inner side of one of said two side plates of said roller frame whereby said biasing spring is provided with a spiral body and two arms, said spiral body being fitted over said first pivot, one of said two arms pressing against said tenon, other one of said two arms pressing against an underside of said rear bracing plate of said boot frame for providing said boot frame with a biasing force enabling said boot frame to remain at said first position at such time when said boot frame is not exerted on by an external force whereby said boot frame moves to locate at said second position at such time when said rear end of said boot frame is exerted on by an external force opposite in direction to and greater than said biasing force;

wherein said boot frame is fastened pivotally with said roller frame by a movable fulcrum, and a fixed fulcrum corresponding in location to the heel of a boot mounted on said boot frame, said fixed fulcrum being separated from said movable fulcrum by a distance; and wherein said rear end of said boot frame turns on said fixed fulcrum toward a first direction, thereby resulting in said front end of said boot frame to turn on said movable fulcrum toward a second direction opposite to said first direction;

wherein said roller frame is formed of two side plates arranged side by side at an interval such that said two side plates are parallel to each other; wherein said rollers are fastened pivotally with said roller frame in such a manner that said rollers are fastened between said two side plates; wherein said boot frame is formed of two side plates, a front bracing plate, and a rear bracing plate, said two side plates being held together by said front bracing plate and said rear bracing plate such that said two side plates are parallel to each other and are separated from each other by a distance greater than said interval between said two side plates of said roller frame whereby said boot frame is fitted over said roller frame such that said front bracing plate of said boot frame is fastened with the toe portion of a boot, and that said rear bracing plate of said boot frame is fastened with the heel portion of the boot; and wherein said side plates of said roller frame and said boot frame are pivotally fastened at a rear end thereof by a first pivot serving as said fixed fulcrum.

* * * * *